United States Patent [19]

Krom

[11] Patent Number: 4,875,707

[45] Date of Patent: Oct. 24, 1989

[54] COMBINED CRAYON AND COLORING BOOK HOLDER

[76] Inventor: Knute R. Krom, 1360 New Loudon Rd., Cohoes, N.Y. 12047

[21] Appl. No.: 199,309

[22] Filed: May 27, 1988

[51] Int. Cl.[4] ..... B42D 3/00; B42D 3/12; A45C 11/34; B43K 25/00

[52] U.S. Cl. ..... 281/30; 281/31; 206/214; 24/10 R

[58] Field of Search ..... 281/30, 31; 401/88, 401/49; 211/69.1; 206/214, 443, 127; 24/10 R

[56] References Cited

U.S. PATENT DOCUMENTS

| | | | |
|---|---|---|---|
| 305,544 | 9/1884 | Stirrup . | |
| 722,123 | 3/1903 | Mills . | |
| 1,217,283 | 2/1917 | Daniel . | |
| 1,833,222 | 11/1931 | Lischeid | 24/10 R |
| 2,285,000 | 6/1942 | Wallace | 24/10 R |
| 2,475,067 | 7/1949 | Wege | 281/31 |
| 3,021,156 | 2/1962 | Coillot | 281/31 |
| 3,126,891 | 3/1964 | Caputi | 206/214 |
| 3,134,416 | 5/1963 | Magyar . | |
| 4,172,332 | 10/1979 | Holes et al. | 281/31 |
| 4,555,018 | 11/1985 | Cho | 281/30 |

FOREIGN PATENT DOCUMENTS

| | | | |
|---|---|---|---|
| 181237 | 7/1954 | Fed. Rep. of Germany | 206/443 |
| 738255 | 12/1932 | France | 281/30 |
| 528238 | 9/1976 | U.S.S.R. | 206/443 |

*Primary Examiner*—Frank T. Yost
*Assistant Examiner*—Paul M. Heyrana
*Attorney, Agent, or Firm*—Schmeiser, Morelle & Watts

[57] ABSTRACT

A book-like receptacle having a plurality of clear cylinders for holding crayons on opposing book surfaces. Opposing cylinders being aligned in registry to lock the book in the closed position. A sleeve in the rear cover of the book enables the user to secure a coloring book to the receptacle.

5 Claims, 3 Drawing Sheets

COMBINED CRAYON AND COLORING BOOK HOLDER

FIELD OF THE INVENTION

This invention relates to crayon holders and more particularly to a book-like receptacle capable of holding crayons and a coloring book.

BACKGROUND OF THE INVENTION

Very few children pass by their early years without obtaining their own crayons and coloring books. Although dutifully bought and given, most parents dread each box of crayons purchased because of the inevitable scattering sure to ensue.

At coloring time crayons are removed after which the crayon box is usually broken, or else parents face the near impossible task of putting all the crayons back into the original box. Even in the rare situation where the crayons are kept in the box after a few uses the most used crayons are shorter and difficult to retrieve from the box.

In addition, children are always taking their crayons and a coloring book with them, upstairs, downstairs, outside, to a friends, in the car and the list goes on and on. Crayon boxes are dropped, as is the coloring book time and time again or else they are left somewhere.

In addition to these frustrations which are common to almost all parents the children also suffer. Often they discover that they don't have the color they wanted or that they have lost a favorite color or coloring book.

The present invention is designed specifically to cure the above described problems. The invention allows full visual inspection of all the crayons while in the stored position provides individual receptacles for each crayon; and also provides means whereby coloring books may be physically attached to the crayon holder.

SUMMARY OF THE INVENTION

The present invention comprises a crayon holding book having a front and a back cover. Cylinders which hold the crayons are located on the inside of the front and back covers. The cylinders are spaced such that when the book is closed the front and back cover cylinders interlock in an interdigital-type registry. A fastening means is further provided on the outside of the back cover for attaching coloring books.

DETAILED DESCRIPTION OF THE DRAWINGS

Figure 1:
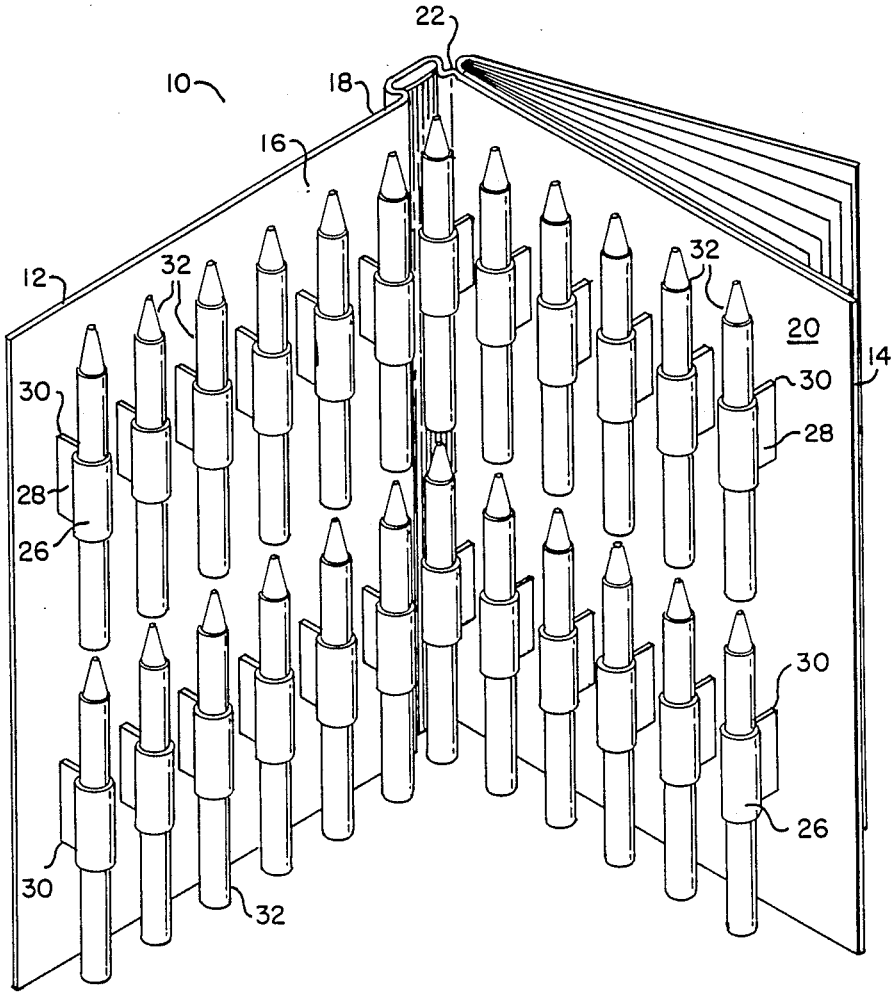
FIG. 1 is a perspective view of the invention in the opened position.

FIG. 1 disclosed the crayon holder generally designated as 10. The crayon holder 10 is in book form having a front cover 12 and a back cover 14. The front cover 12 has an inner surface 16 and an outer surface 18. Similarly, the back cover 14 has an inner surface 20 and an outer surface 22. The front and back covers are connected at a binding 24.

The inner surfaces 16 and 20 have two rows of cylinders 26 which are transparent. Connected to each cylinder, in my preferred embodiment, and formed integrally therewith is an attachment strip 28 which serves to raise the cylinder from the inner surface. In my preferred mode of manufacture the cylinders of each row on each surface would be formed from one piece of material which is drawn through openings 30 to form each of the attachment strips 28 and cylinders 26. The attachment strip is formed from 2 pieces of material which are secured together leaving the cylinder with a sufficient diameter to snuggly secure a crayon 32 inserted therein.

Figure 3:
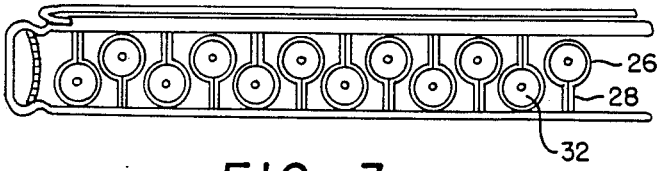
FIG. 3 is an elevational view from the top of the invention in the closed position.
Figure 4:
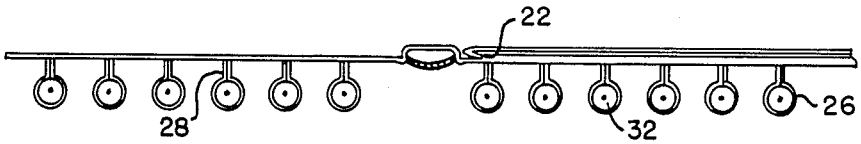
FIG. 4 is an elevational view from the top of the invention in the opened position.
Figure 5:
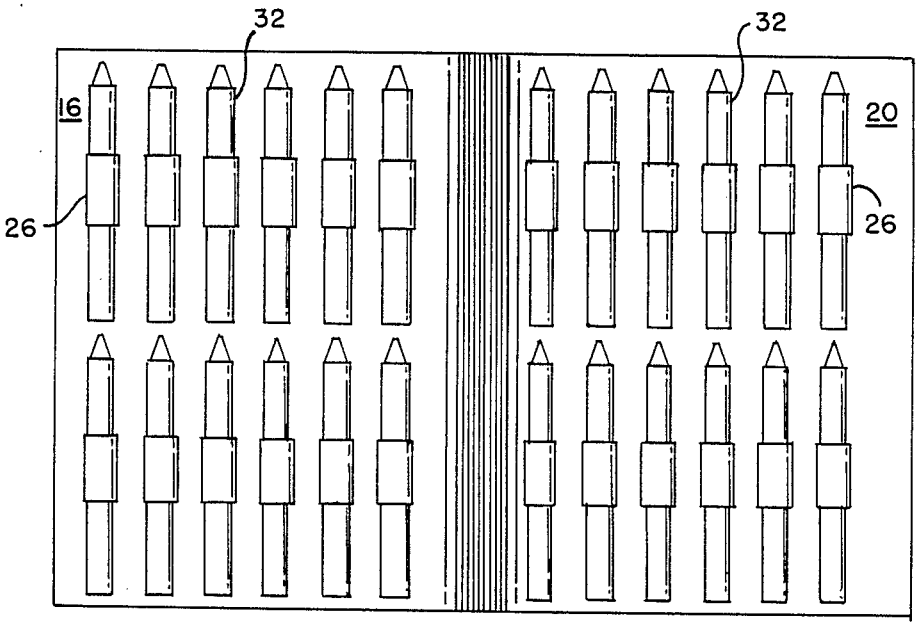
FIG. 5 is a plane view of the interior of the crayon holder in the opened position.

When the book is closed, as shown in FIG. 3 the crayons, and cylinders from one inner surface are aligned adjacent to and, except for the end crayons, between crayons and cylinders from the other inner surface. The attachment strip allows the crayons to have a certain degree of lateral movement so that as the book closes the crayons and cylinders can move apart allowing the entrance between them of a crayon and cylinder from the other surface. In this manner the cylinders are in an interdigital-type registry and serve to lock the book in a closed position. In order to accomplish this the cylinders on each inner surface are spaced apart from one and other with the distance between adjacent cylinders being slightly less than the diameter of a cylinder. As shown in FIGS. 4 and 5 the cylinders on the inner surface of the front cover are off set from the cylinders on the inner surface of the back cover to allow for this interlocking registry.

Figure 2:
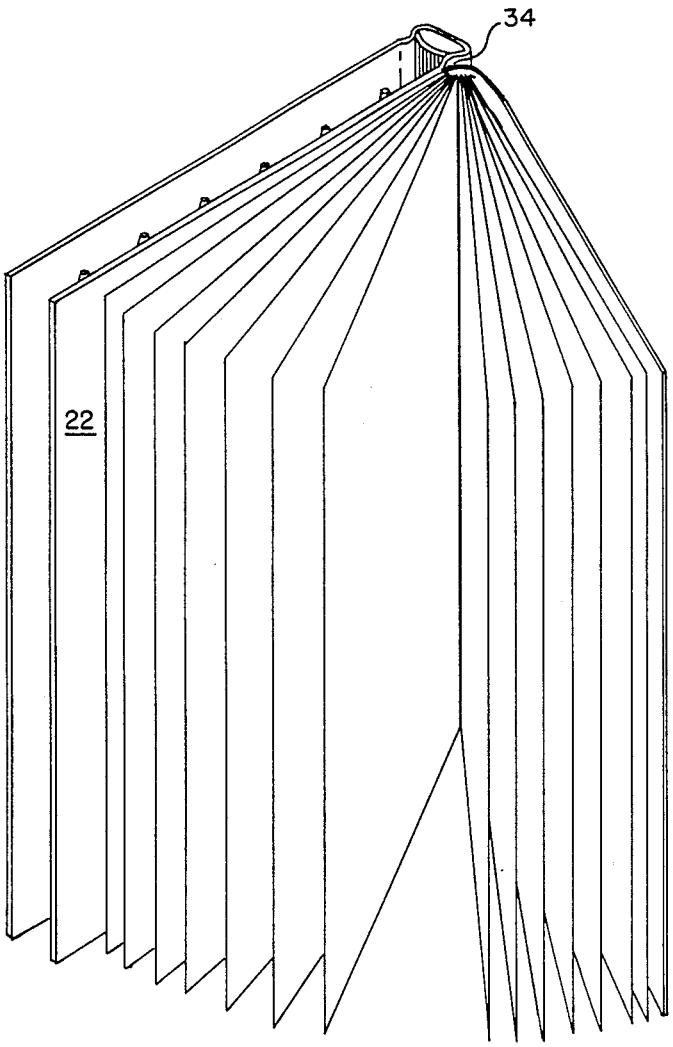
FIG. 2 is a rear perspective view of the invention showing a coloring book attached thereto.

FIG. 2 shows the subject invention with a coloring book attached thereto. This is accomplished by having an attachment means on the outer surface 22 of the back cover. In my preferred embodiment the attachment means is simply a slit 34 into which the frint page or pages of the coloring book are inserted. The slit 34 travels the length of the back cover and is parallel to the binding. The slit allows the front pages of the coloring book to be inserted between the outer ciover and the back cover stiffening material (not shown).

The above describes the preferred embodiment of the subject invention. However, it is anticipated that the subject invention shall only be limited by the appended claims.

I claim:

1. A book-like receptacle for crayons comprising:

a front cover and back cover secured to each other, each cover having inner and outer surfaces;

a plurality of cylinders for holding crayons secured to the inner surfaces of the said front and back covers;

said front cover cylinders and back cover cylinders spaced apart from adjacent cylinders on the same cover, the distance between adjacent cylinders on the same cover being slightly less than the diameter of a cylinder such that when adjacent cylinders are full and the book is closed the cylinders will be in interdigital-type registry, adjacent front and back cylinders interlocking, and securing the book in the closed position.

2. The invention of claim 1, wherein said cylinders are transparent thereby allowing full visual inspection of the held crayons.

3. The invention of claim 2, wherein said cylinder securing means comprises an attachment strip of flexible material, and integral with the exterior wall of the cylinder and secured to the inner surface of the covers whereby during closure of the book the adjacent front and back cover cylinders may spread when contacting and return back to their original state after the cylinders pass each other, interlocking and securing the book in the closed position.

4. The invention of claim 1 further comprising coloring book fastening means secured to the outer surface of the back cover.

5. The invention of claim 4, wherein said coloring book fastening means comprises the back cover having a cavity therein, said cavity lying coplanar with the outer surface of the back cover, the outer surface of the back cover having a slit, said slit located near and lying parallel to the book's binding for the introduction of the front cover of a coloring book into the cavity thereby securing the coloring book.

* * * * *